US009378675B2

(12) United States Patent
Kim et al.

(10) Patent No.: US 9,378,675 B2
(45) Date of Patent: Jun. 28, 2016

(54) PIXEL DRIVEN BY MULTIPLE CONTROL SIGNALS AND ORGANIC LIGHT EMITTING DISPLAY DEVICE USING THE SAME

(71) Applicant: SAMSUNG DISPLAY CO., LTD., Yongin, Gyeonggi-Do (KR)

(72) Inventors: Yong-Jae Kim, Yongin (KR); Hae-Yeon Lee, Yongin (KR); Bo-Yong Chung, Yongin (KR); Jin-Gon Oh, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 142 days.

(21) Appl. No.: 14/060,883

(22) Filed: Oct. 23, 2013

(65) Prior Publication Data

US 2014/0353608 A1 Dec. 4, 2014

(30) Foreign Application Priority Data

May 29, 2013 (KR) ..... 10-2013-0060868

(51) Int. Cl.
*G09G 3/30* (2006.01)
*G09G 3/32* (2016.01)

(52) U.S. Cl.
CPC ..... *G09G 3/3233* (2013.01); *G09G 2300/0852* (2013.01); *G09G 2300/0861* (2013.01)

(58) Field of Classification Search
CPC ..... G09G 3/30; G09G 3/3208; G09G 3/3233
USPC ..... 345/76–77
See application file for complete search history.

(56) References Cited

U.S. PATENT DOCUMENTS

| | | | | |
|---|---|---|---|---|
| 2005/0017934 | A1 | 1/2005 | Chung et al. | |
| 2007/0035487 | A1 * | 2/2007 | Ryu et al. | 345/76 |
| 2010/0253608 | A1 * | 10/2010 | Kim et al. | 345/76 |
| 2012/0038605 | A1 * | 2/2012 | Han | 345/211 |
| 2012/0113077 | A1 | 5/2012 | Kang | |
| 2014/0139408 | A1 | 5/2014 | Kim et al. | |

FOREIGN PATENT DOCUMENTS

| | | |
|---|---|---|
| KR | 1020050005646 | 1/2005 |
| KR | 1020120048294 | 5/2012 |
| KR | 1020140065937 | 5/2014 |

* cited by examiner

*Primary Examiner* — Roy Rabindranath
(74) *Attorney, Agent, or Firm* — F. Chau & Associates, LLC

(57) ABSTRACT

There is provided a pixel, including an organic light emitting diode (OLED), a first transistor whose gate electrode is coupled to a first node, whose first electrode is coupled to a first power supply via a third node, and whose second electrode is coupled to an anode electrode of the OLED, a second transistor coupled between a data line and a second node and turned on when a scan signal is supplied to a scan line, a first capacitor coupled between the second node and a first voltage source, a third transistor coupled between the second node and the first node and turned on when a second control signal is supplied, and a fourth transistor coupled between the first node and the first power supply and turned on when a first control signal is supplied.

24 Claims, 8 Drawing Sheets

PIXEL DRIVEN BY MULTIPLE CONTROL SIGNALS AND ORGANIC LIGHT EMITTING DISPLAY DEVICE USING THE SAME

CROSS-REFERENCE TO RELATED APPLICATION

This application claims priority to Korean Patent Application No. 10-2013-0060868, filed on May 29, 2013, in the Korean Intellectual Property Office, the disclosure of which is incorporated by reference in its entirety.

BACKGROUND

1. Technical Field

Exemplary embodiments of the inventive concept relate to a pixel and an organic light emitting display device using the same.

2. Discussion of Related Art

Flat panel displays (FPD) have reduced weight and volume as compared to cathode ray tubes (CRT). The FPDs include liquid crystal displays (LCD), field emission displays (FED), plasma display panels (PDP), and organic light emitting display devices.

Among the FPDs, the organic light emitting display devices display images using organic light emitting diodes (OLED) that generate light by re-combination of electrons and holes. The organic light emitting display device has a high response speed and is driven with a low power consumption.

SUMMARY

At least one embodiment of the present inventive concept relates to a pixel capable of improving display quality and an organic light emitting display device using the same.

A pixel according to an exemplary embodiment of the present inventive concept includes an organic light emitting diode (OLED), a first transistor whose gate electrode is coupled to a first node, whose first electrode is coupled to a first power supply via a third node, and whose second electrode is coupled to an anode electrode of the OLED, a second transistor coupled between a data line and a second node and turned on when a scan signal is supplied to a scan line, a first capacitor coupled between the second node and a first voltage source, a third transistor coupled between the second node and the first node and turned on when a second control signal is supplied, and a fourth transistor coupled between the first node and the first power supply and turned on when a first control signal is supplied.

In an exemplary embodiment of the pixel, turn-on periods of the second transistor, the third transistor, and the fourth transistor do not overlap.

The pixel may further include a fifth transistor coupled between the first node and a fourth node, turned off when an emission control signal is supplied to an emission control line, and turned on when the emission control signal is not supplied to the emission control line and a second capacitor coupled between the fourth node and the third node.

In an exemplary embodiment of the pixel, a turn-on period of the fifth transistor does not overlap the turn-on periods of the third transistor and the fourth transistor.

The fifth transistor may be set in a turn-on state during a period when the second transistor is turned on.

The pixel may further include a sixth transistor coupled between the data line and the fourth node and turned on when the second control signal is supplied, a seventh transistor coupled between the fourth node and a second voltage supply and turned on when the first control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between an anode electrode of the OLED and an initializing power supply and turned on when the second control signal is supplied.

A voltage of the initializing power supply may be set so that a current from the first transistor flows via the tenth transistor during a period when the second control signal is supplied.

The first voltage supply and the second voltage supply may be the initializing power supply.

The pixel may further include an $11^{th}$ transistor coupled between a fifth node that is a common node of the tenth transistor and the second electrode of the first transistor and the anode electrode of the OLED, turned off when the emission control signal is supplied to the emission control line, and turned on when the emission control signal is not supplied to the emission control line and a $12^{th}$ transistor coupled between the anode electrode of the OLED and the initializing power supply and turned on when the first control signal is supplied.

The pixel further include a sixth transistor coupled between the data line and the fourth node and turned on when the second control signal is supplied, a seventh transistor coupled between the data line and the fourth node to run parallel with the sixth transistor and turned on when the first control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between the anode electrode of the OLED and an initializing power supply and turned on when the second control signal is supplied.

The pixel may further include an $11^{th}$ transistor coupled between a fifth node that is a common node of the tenth transistor and the second electrode of the first transistor and the anode electrode of the OLED, turned off when the emission control signal is supplied to the emission control line, and turned on when the emission control signal is not supplied to the emission control line and a $12^{th}$ transistor coupled between the anode electrode of the OLED and the initializing power supply and turned on when the first control signal is supplied.

The pixel further include a sixth transistor coupled between the data line and the fourth node and turned on when a third control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between the anode electrode of the OLED and an initializing power supply and turned on when the third control signal is supplied.

In an exemplary embodiment of the pixel, a turn-on period of the sixth transistor overlaps the turn-on periods of the third transistor and the fourth transistor.

An organic light emitting display device according to an exemplary embodiment of the present inventive concept includes a control driver configured to supply a first control signal to a first control line during a first period of one frame and to supply a second control signal to a second control line during a second period of one frame, a scan driver configured to sequentially supply scan signals to scan lines during a third period of the one frame and to supply an emission control signal to an emission control line during the first period and the second period of the one frame, a data driver configured to supply a reference power supply to data lines during the first period and the second period and to supply data signals to the data lines in synchronization with the scan signals during the third period, and pixels. The pixels may be positioned in regions partitioned by the scan lines and the data lines. At least one of the pixels includes an organic light emitting diode (OLED), a first transistor whose gate electrode is coupled to a first node, whose first electrode is coupled to a first power supply via a third node, and whose second electrode is coupled to an anode electrode of the OLED, a second transistor coupled between a data line and a second node and turned on when a scan signal is supplied to one of the scan lines corresponding to the one pixel, a first capacitor coupled between the second node and a first voltage source, a third transistor coupled between the second node and the first node and turned on when a second control signal is supplied, and a fourth transistor coupled between the first node and the first power supply and turned on when a first control signal is supplied. In an exemplary embodiment, the pixels are arranged in horizontal rows or lines.

The reference power supply may be set as a specific voltage within a voltage range of the data signals.

The one pixel may further includes a fifth transistor coupled between the first node and a fourth node, turned off when the emission control signal is supplied, and turned on when the emission control signal is not supplied and a second capacitor coupled between the fourth node and the third node.

The one pixel may further include a sixth transistor coupled between the data line and the fourth node and turned on when the second control signal is supplied, a seventh transistor coupled between the fourth node and a second voltage supply and turned on when the first control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between the anode electrode of the OLED and an initializing power supply and turned on when the second control signal is supplied.

A voltage of the initializing power supply may be set so that a current from the first transistor flows via the tenth transistor during the second period.

The first voltage supply and the second voltage supply may be the initializing power supply.

The pixel may further include an $11^{th}$ transistor coupled between a fifth node that is a common node of the tenth transistor and the second electrode of the first transistor and the anode electrode of the OLED, turned off when the emission control signal is supplied, and turned on when the emission control signal is not supplied and a $12^{th}$ transistor coupled between the anode electrode of the OLED and the initializing power supply and turned on when the first control signal is supplied.

The one pixel may further include a sixth transistor coupled between the data line and the fourth node and turned on when the second control signal is supplied, a seventh transistor coupled between the data line and the fourth node to run parallel with the sixth transistor and turned on when the first control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between the anode electrode of the OLED and an initializing power supply and turned on when the second control signal is supplied.

The one pixel may further include an $11^{th}$ transistor coupled between a fifth node that is a common node of the tenth transistor and the second electrode of the first transistor and the anode electrode of the OLED, turned off when the emission control signal is supplied, and turned on when the emission control signal is not supplied and a $12^{th}$ transistor coupled between the anode electrode of the OLED and the initializing power supply and turned on when the first control signal is supplied.

The control driver may supply a third control signal to a third control line during the first period and the second period.

The one pixel may further include a sixth transistor coupled between the data line and the fourth node and turned on when a third control signal is supplied, an eighth transistor coupled between the first power supply and the third node and turned on when the first control signal is supplied, a ninth transistor coupled between the first power supply and the third node, turned off when the emission control signal is supplied, and turned on when the emission control signal is not supplied, and a tenth transistor coupled between the anode electrode of the OLED and an initializing power supply and turned on when the third control signal is supplied.

An organic light emitting display device according to an exemplary embodiment of the present inventive concept includes a scan driver, a data driver, and a plurality of pixels. The scan driver is configured to supply a first control signal to a first control line during a first period of one frame, a second control signal to a second control line during a second period of the one frame, and scan signals to scan lines of the display device. One of the pixels includes an OLED, and first-fourth transistors. The first transistor has a gate electrode coupled to a first node, a first electrode coupled to a first power supply via a third node, and a second electrode coupled to an anode electrode of the OLED. The second transistor is coupled between one of the data lines and a second node and has a gate electrode that receives one of the scan signals. The third transistor is coupled between the second node and the first node and has a gate electrode that receives the second control signal from the second control line. The fourth transistor is coupled between the first node and the first power supply and has a gate electrode that receives the first control signal from the first control line.

BRIEF DESCRIPTION OF THE DRAWINGS

The present inventive concept will be more apparent from the following detailed description taken in conjunction with the accompanying drawings, in which.

DETAILED DESCRIPTION

Figure 1:
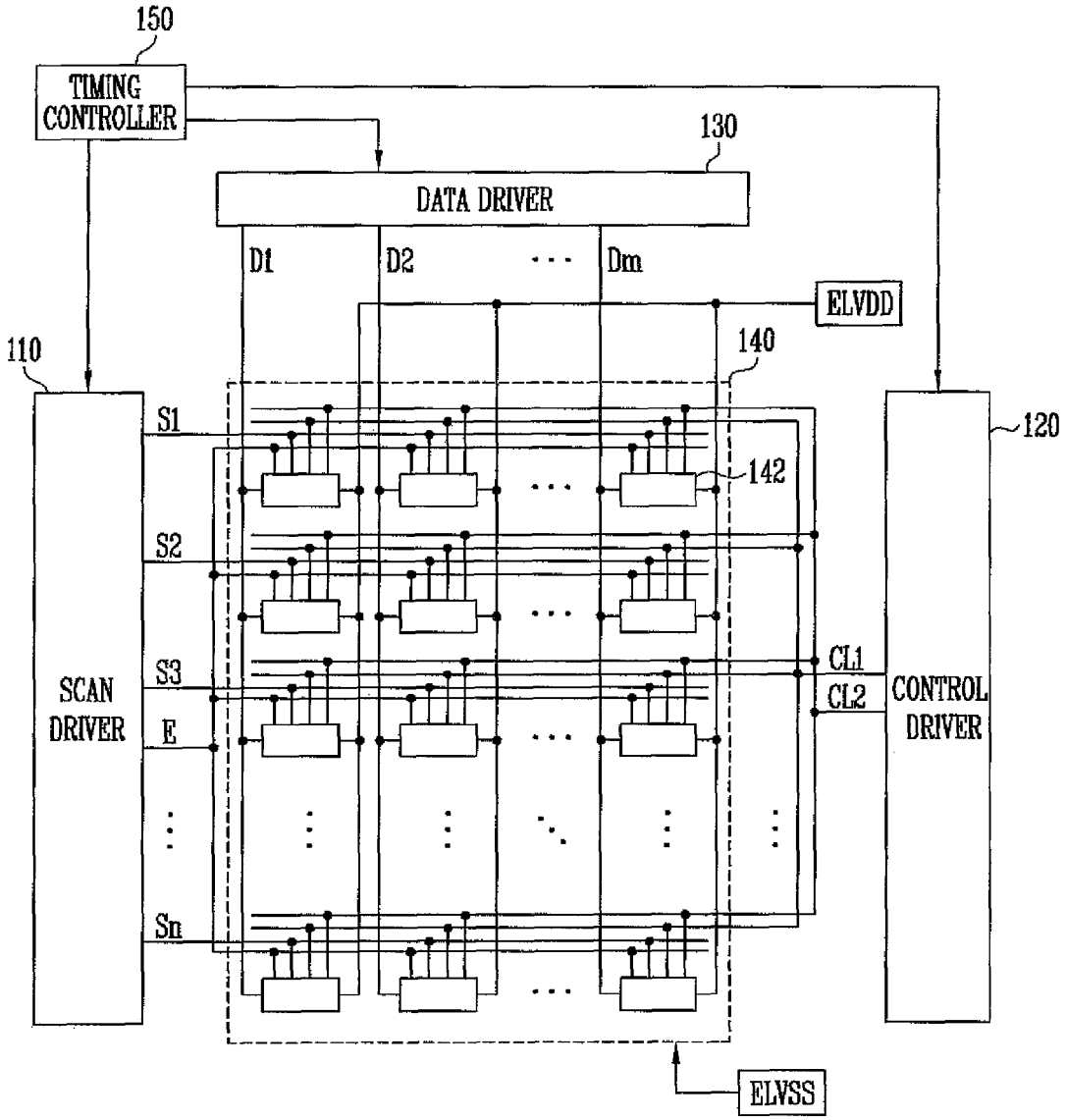
FIG. 1 is a view illustrating an organic light emitting display device according to an exemplary embodiment of the present inventive concept.

Exemplary embodiments of the inventive concept will now be described more fully hereinafter with reference to the accompanying drawings. However, the inventive concept may be embodied in different forms and should not be construed as limited to the embodiments set forth herein.

In the drawing figures, the thickness of layers and regions may be exaggerated for clarity. It will be understood that when an element is referred to as being "on" or "connected to" another element or layer, it can be directly on or connected to the other element or layer, or one or more intervening elements may also be present. Like reference numerals refer to like elements throughout. The use of the terms "a" and "an" in the context of the inventive concept are to be construed to cover both the singular and the plural, unless otherwise indicated herein or clearly contradicted by context.

FIG. 1 is a view illustrating an organic light emitting display device according to an exemplary embodiment of the present inventive concept.

Referring to FIG. 1, an organic light emitting display device according to an exemplary embodiment of the present inventive concept includes a pixel unit 140 including pixels 142 positioned in regions partitioned by scan lines S1 to Sn and data lines D1 to Dm, a scan driver 110 configured to drive the scan lines S1 to Sn and an emission control line E, a control driver 120 configured to drive a first control line CL1 and a second control line CL2, a data driver 130 configured to drive the data lines D1 to Dm, and a timing controller 150 configured to control the drivers 110, 120, and 130.

Figure 3:
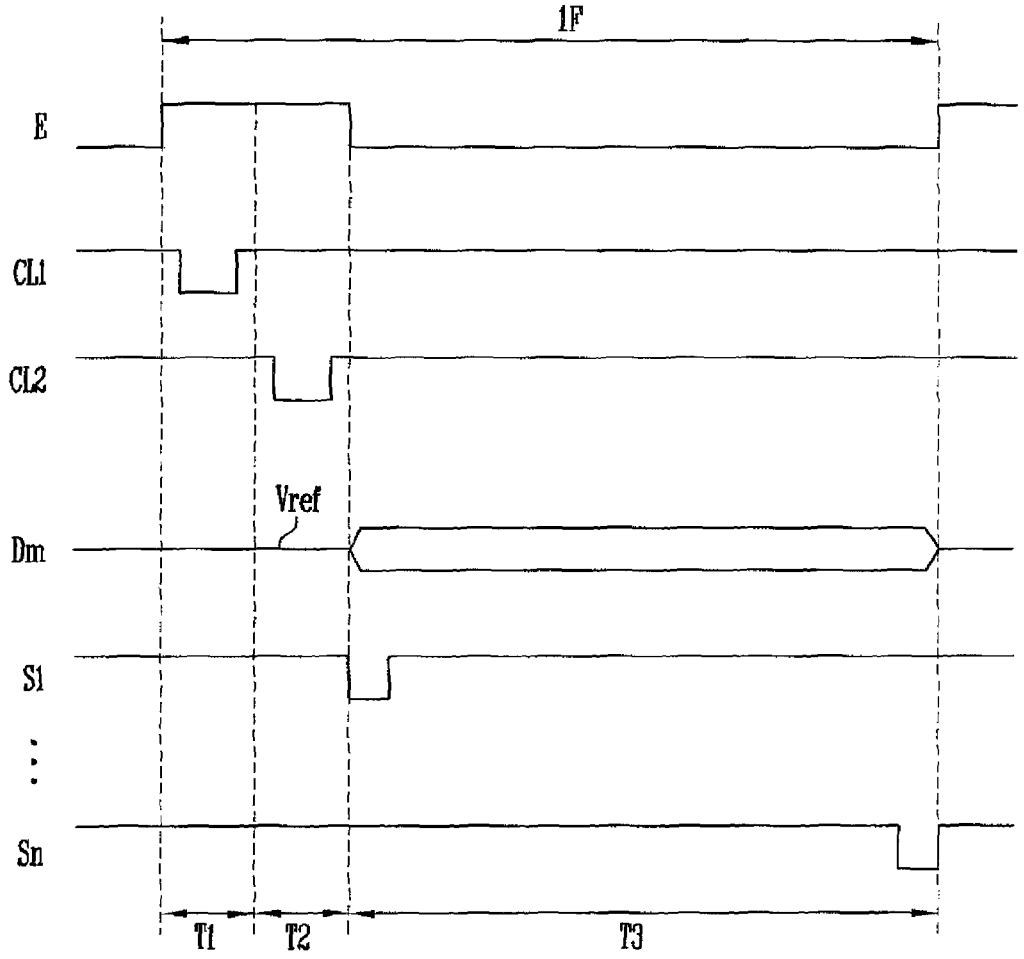
FIG. 3 is a waveform diagram illustrating a method of driving the pixel illustrated in FIG. 2 according to an exemplary embodiment of the inventive concept.

The scan driver 110 supplies scan signals to the scan lines S1 to Sn. For example, the scan driver 110 may sequentially supply the scan signals to the scan lines S1 to Sn during a third period T3 of one frame 1F as illustrated in FIG. 3. In addition, the scan driver 110 may supply an emission control signal to the emission control line E commonly coupled to the pixels 142 during a first period T1 and a second period T2 of the frame 1F. Here, the scan signals are set to have voltages (for example, low voltages) when transistors included in the pixels 142 are turned on and the emission control signal is set to have a voltage (for example, a high voltage) when transistors included in the pixels 142 are turned off.

The control driver 120 drives the first control line CL1 and the second control line CL2 commonly coupled to the pixels 142. For example, the control driver 120 supplies a first control signal to the first control line CL during the first period T1 and supplies a second control signal to the second control line CL2 during the second period T2. Here, the first control signal and the second control signal are set to have voltages that cause the transistors included in the pixels 142 to be turned on.

The data driver 130 supplies the data signals to the data lines D1 to Dm in synchronization with the scan signals sequentially supplied to the scan lines S1 to Sn during the third period T3 of the one frame 1F. The data driver 130 supplies a reference voltage Vref to the data lines D1 to Dm during the first period T1 and the second period T2 of the one frame 1F. Here, the reference voltage Vref is set to a specific voltage within a voltage range of the data signals.

The timing controller 150 controls the scan driver 110, the control driver 120, and the data driver 130 to correspond to synchronizing signals, which may be supplied from the outside.

The pixel unit 140 includes the pixels 142 positioned in regions partitioned by the scan lines S1 to Sn and the data lines D1 to Dm. The pixels 142 initialize voltages of gate electrodes of driving transistors during the first period T1 and compensate for threshold voltages of the driving transistors and perform control so that voltages corresponding to previous data signals are supplied to the gate electrodes of the driving transistors during the second period T2. The pixels 142 charge current data signals and generate light components with predetermined brightness components to correspond to the previous data signals during the third period T3.

In FIG. 1, for convenience sake, it is illustrated that the emission control line E is coupled to the scan driver 110 and the control lines CL1 and CL2 are coupled to the control driver 120. However, the present inventive concept is not limited thereto. For example, the emission control line E and the control lines CL1 and CL2 may be coupled to various different drivers. For example, the emission control line E and the control lines CL1 and CL2 may be instead coupled to the scan driver 110.

Figure 2:
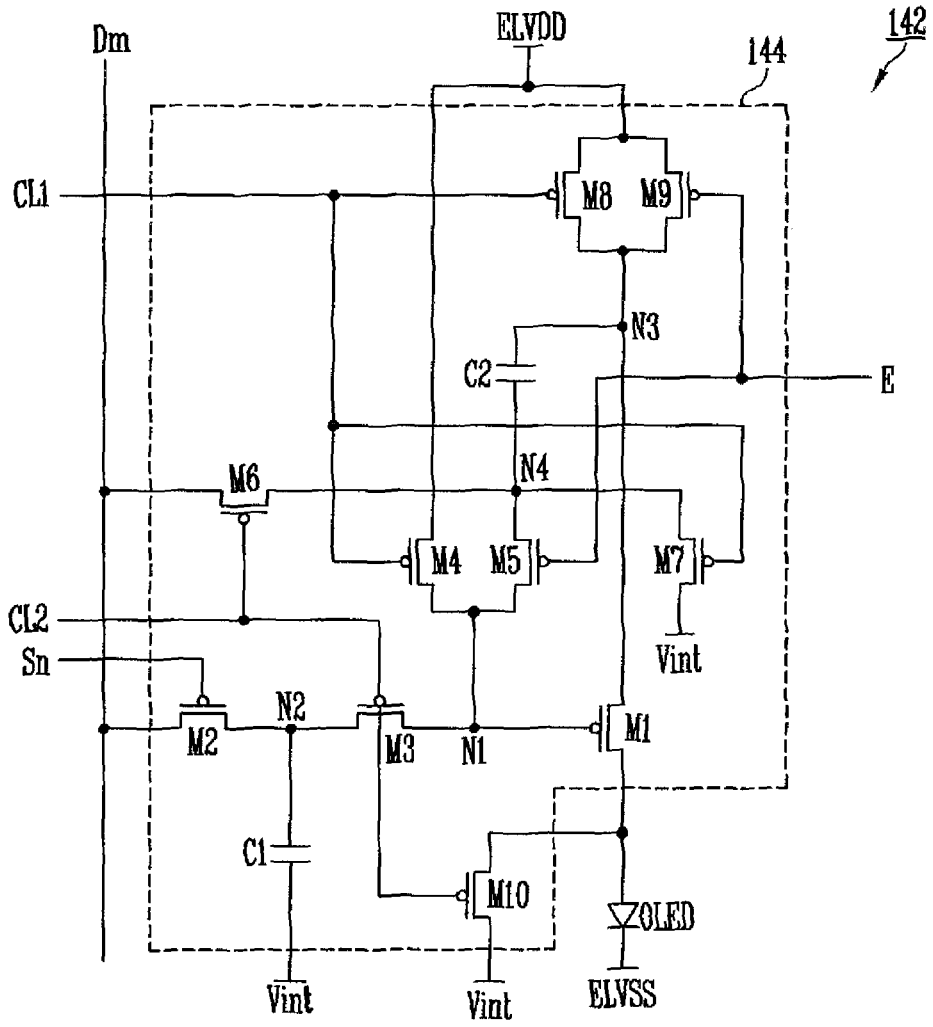
FIG. 2 is a view of the pixel illustrated in FIG. 1 according to an exemplary embodiment of the inventive concept.

FIG. 2 is a view illustrating an exemplary embodiment of the pixel illustrated in FIG. 1. In FIG. 2, for convenience sake, a pixel coupled to the nth scan line Sn and the mth data line Dm will be illustrated. However, the display device may include several such pixels.

Referring to FIG. 2, a pixel 142 according to an exemplary embodiment of the present inventive concept includes an organic light emitting diode (OLED) and a pixel circuit 144 configured to control an amount of current supplied to the OLED.

An anode electrode of the OLED is coupled to the pixel circuit 144 and a cathode electrode of the OLED is coupled to the second power supply ELVSS. The OLED generates light with a predetermined brightness to correspond to the amount of current supplied from the pixel circuit 144. In an exemplary embodiment, the second power supply ELVSS is set to have a lower voltage than that of the first power supply ELVDD.

The pixel circuit 144 controls the amount of current supplied to the OLED to correspond to the data signal. The pixel circuit 144 includes first to tenth transistors M1 to M10, a first capacitor C1, and a second capacitor C2.

A first electrode of the first transistor M1 (that is, a driving transistor) is coupled to a third node N3 and a second electrode of the first transistor M1 is coupled to the anode electrode of the OLED. A gate electrode of the first transistor M1 is coupled to a first node N1. The first transistor M1 controls the amount of current supplied to the OLED to correspond to a voltage applied to the first node N1.

A first electrode of the second transistor M2 is coupled to the data line Dm and a second electrode of the second transistor M2 is coupled to a second node N2. A gate electrode of the second transistor M2 is coupled to the scan line Sn. The second transistor M2 is turned on when the scan signal is supplied to the scan line Sn to electrically couple the data line Dm and the second node N2.

A first electrode of the third transistor M3 is coupled to the second node N2 and a second electrode of the third transistor M3 is coupled to the first node N1. A gate electrode of the third transistor M3 is coupled to the second control line CL2. The third transistor M3 is turned on when the second control signal is supplied to the second control line CL2 to electrically couple the second node N2 and the first node N1.

A first electrode of the fourth transistor M4 is coupled to the first power supply ELVDD and a second electrode of the fourth transistor M4 is coupled to the first node N1. A gate electrode of the fourth transistor M4 is coupled to the first control line CL1. The fourth transistor M4 is turned on when the first control signal is supplied to the first control line CL1 to supply a voltage of the first power supply ELVDD to the first node N1.

A first electrode of the fifth transistor M5 is coupled to a fourth node N4 and a second electrode of the fifth transistor M5 is coupled to the first node N1. A gate electrode of the sixth transistor M6 is coupled to the second control line CL2. The sixth transistor M6 is turned on when the second control signal is supplied to the second control line CL2 to electrically couple the data line Dm and the fourth node N4.

A first electrode of the seventh transistor M7 is coupled to the fourth node N4 and a second electrode of the seventh transistor M7 is coupled to a second voltage supply. A gate electrode of the seventh transistor M7 is coupled to the first control line CL1. The seventh transistor M7 is turned on when the first control signal is supplied to the first control line CL1 to supply a voltage of the second voltage supply to the fourth node N4. Here, the second voltage supply may be set as a voltage supply configured to supply a fixed voltage, for example, an initializing power supply Vint.

A first electrode of the eighth transistor M8 is coupled to the first power supply ELVDD and a second electrode of the eighth transistor M8 is coupled to the third node N3 . A gate electrode of the eighth transistor M8 is coupled to the first control line CL1. The eighth transistor M8 is turned on when the first control signal is supplied to the first control line CL1 to supply a voltage of the first power supply ELVDD to the third node N3.

A first electrode of the ninth transistor M9 is coupled to the first power supply ELVDD and a second electrode of the ninth transistor M9 is coupled to the third node N3 . A gate electrode of the ninth transistor M9 is coupled to the emission control line E. The ninth transistor M9 is turned off when the emission control signal is supplied to the emission control line E and is turned on when the emission control signal is not supplied to the emission control line E.

A first electrode of the tenth transistor M10 is coupled to the anode electrode of the OLED and a second electrode of the tenth transistor M10 is coupled to the initializing power supply Vint. A gate electrode of the tenth transistor M10 is coupled to the second control line CL2. The tenth transistor M10 is turned on when the second control signal is supplied to the second control line CL2 to supply a voltage of the initializing power supply Vint to the anode electrode of the OLED. In an exemplary embodiment, the voltage of the initializing power supply Vint is set so that a current supplied via the first transistor M1 is supplied to the initializing power supply Vint during a period when the tenth transistor M10 is turned on.

The first capacitor C1 is coupled between the second node N2 and a first voltage supply. The first capacitor C1 is charged with a voltage corresponding to the data signal during a period when the second transistor M2 is turned on. In an exemplary embodiment, the first voltage supply is set as a voltage supply configured to supply a fixed voltage, for example, the initializing power supply Vint.

The second capacitor C2 is coupled between the fourth node N4 and the third node N3 . The second capacitor C2 is charged with a voltage corresponding to the data signal and a threshold voltage of the first transistor M1. In an exemplary embodiment, the second capacitor C2 is not charged by a charge sharing method with the first capacitor C1. That is, in a period when the voltage of the data signal Dm is supplied from the first capacitor C1 to the first node N1, the second capacitor C2 is electrically insulated from the first node N1.

When the second capacitor C2 is not charged by the charge sharing method with the first capacitor C1, the first capacitor C1 may have a capacitance similar to or the same as that of the second capacitor C2. In an exemplary embodiment, when the second capacitor C2 is charged by the charge sharing method, the first capacitor C1 is set to have a capacitance higher than that of the second capacitor C2 so that a layout area is increased. In an exemplary embodiment, when the second capacitor C2 is charged by the charge sharing method, the first capacitor C1 is set to have a capacitance no less than five times higher than that of the second capacitor C2.

FIG. 3 is an exemplary waveform diagram illustrating a method of driving the pixel illustrated in FIG. 2 according to an exemplary embodiment of the inventive concept.

Referring to FIG. 3, the one frame 1F according to the embodiment of the present inventive concept is divided into the first period T1 to the third period T3. During the first period T1, the first node N1, the third node N3 , and the fourth node N4 are initialized. During the second period T2, the threshold voltage of the first transistor M1 is compensated for and the voltage corresponding to a previous data signal is supplied to the gate electrode of the first transistor M1. During the third period T3, the current data signal is charged and light with a predetermined brightness is generated to correspond to the previous data signal.

The operation process will be described in detail. During the first period T1 and the second period T2, the emission control signal is supplied to the emission control line E. For example, during the entire first and second periods T1 and T2, the emission control signal is activated. When the activated emission control signal is supplied to the emission control line E, the fifth transistor M5 and the ninth transistor M9 are turned off. When the fifth transistor M5 is turned off the first node N1 and the fourth node N4 are electrically insulated from each other.

During the first period T1, the first control signal is activated and supplied to the first control line CL1. When the activated first control signal is supplied to the first control line CL1, the fourth transistor M4, the seventh transistor M7, and the eighth transistor M8 are turned on.

When the eighth transistor M8 is turned on, the voltage of the first power supply ELVDD is supplied to the third node N3 . When the fourth transistor M4 is turned on, the voltage of the first power supply ELVDD is supplied to the first node N1. When the voltage of the first power supply ELVDD is supplied to the first node N1 and the third node N3 , the first transistor M1 is turned off. That is, during the first period T1, the first transistor M1 is initialized to an off bias state regardless of the voltage of the previous data signal so that an image with a uniform brightness may be displayed. When the seventh transistor M7 is turned on, the voltage of the initializing power supply Vint is supplied to the fourth node N4. That is, during the first period T1, the fourth node N4 is initialized to the voltage of the initializing power supply Vint.

During the second period T2, the second control signal is activated and supplied to the second control line CL2. When the activated second control signal is supplied to the second control line CL2, the third transistor M3, the sixth transistor M6, and the tenth transistor M10 are turned on.

When the sixth transistor M6 is turned on, a voltage of a reference power supply Vref from the data line Dm is supplied to the fourth node N4. When the tenth transistor M10 is turned on, the initializing power supply Vint and the anode electrode of the OLED are electrically coupled to each other. In this case, the current supplied from the first transistor M1 is supplied to the initializing power supply Vint via the tenth transistor M10.

When the third transistor M3 is turned on, the voltage of the data signal stored in the first capacitor C1 is supplied to the first node N1. At this time, since the fifth transistor M5 is set in a turn-off state, the second capacitor C2 is not electrically coupled to the first capacitor C1. When the voltage of the data signal is supplied to the first node N1, a voltage of the third node N3 is reduced from the voltage of the first power supply ELVDD to a voltage corresponding to the sum of the voltage of the data signal and an absolute value of a threshold voltage of the first transistor M1. At this time, the second capacitor C2 is charged with a voltage corresponding to a difference between a voltage of the fourth node N4 and the voltage of the third node N3 , that is, the voltage corresponding to the threshold voltage of the first transistor M1 and the data signal. The voltage of the reference power supply Vref is set to the specific voltage within the voltage range of the data signals. Therefore, when voltages of the data signals are controlled to be higher or lower than the reference voltage Vref, predetermined gray scales may be realized.

During the third period T3, supply of the emission control signal to the emission control line E is stopped. For example, during the third period T3, the emission control signal is deactivated (i.e., set to a different level than the activated level. When the supply of the emission control signal to the emission control line E is stopped, the fifth transistor M5 and the ninth transistor M9 are turned on. When the ninth transistor M9 is turned on, the voltage of the first power supply ELVDD is supplied to the third node N3 . When the fifth transistor M5 is turned on, the first node N1 and the fourth node N4 are electrically coupled to each other. At this time, the voltage of the first node N1 is set to the voltage of the reference power supply Vref. Then, a voltage difference between the first electrode of the first transistor M1 and the gate electrode of the first transistor M1 is set to a voltage obtained by subtracting the voltage of the reference power supply Vref from the voltage corresponding to the sum of the voltage of the data signal and the absolute value of the threshold voltage of the first transistor M1. Here, since the voltage of the reference power supply Vref is a fixed voltage, an amount of current that flows through the first transistor M is determined by the data signal and the threshold voltage of the first transistor M1.

During the third period T3, the scan signals are sequentially supplied to the scan lines S1 to Sn. When the scan signal is supplied to the scan line Sn, the second transistor M2 is turned on. For example, FIG. 3 depicts that a scan signal transitions from a high level to a low level, and either upon that transition or shortly thereafter, the second transistor M2 may be turned on. When the second transistor M2 is turned on, the data signal supplied to the data line Dm in synchronization with the scan signal supplied to the scan line Sn is supplied to the second node N2 so that the first capacitor C1 stores the voltage corresponding to the data signal.

In an exemplary embodiment of the present inventive concept, the above-described processes are repeated to realize predetermined gray scales. For example, the above-described driving steps may be repeated for each pixel within the display device. As described above, according to the present inventive concept, during a period when the second capacitor C2 is charged, the second capacitor C2 is not electrically coupled to the first capacitor C1 so that a capacitance of the first capacitor C1 may be minimized. Furthermore, according to the present inventive concept, a period in which the second control signal is supplied to the second control line CL2 is controlled so that it is possible to secure a large enough period of compensating for the threshold voltage and to improve display quality. Furthermore, in the pixel 142 according to at least one embodiment of the present inventive concept, since the first power supply ELVDD and the second power supply ELVSS maintain constant voltages during a frame period, power consumption and electromagnetic interference (EMI) may be reduced.

Figure 4:
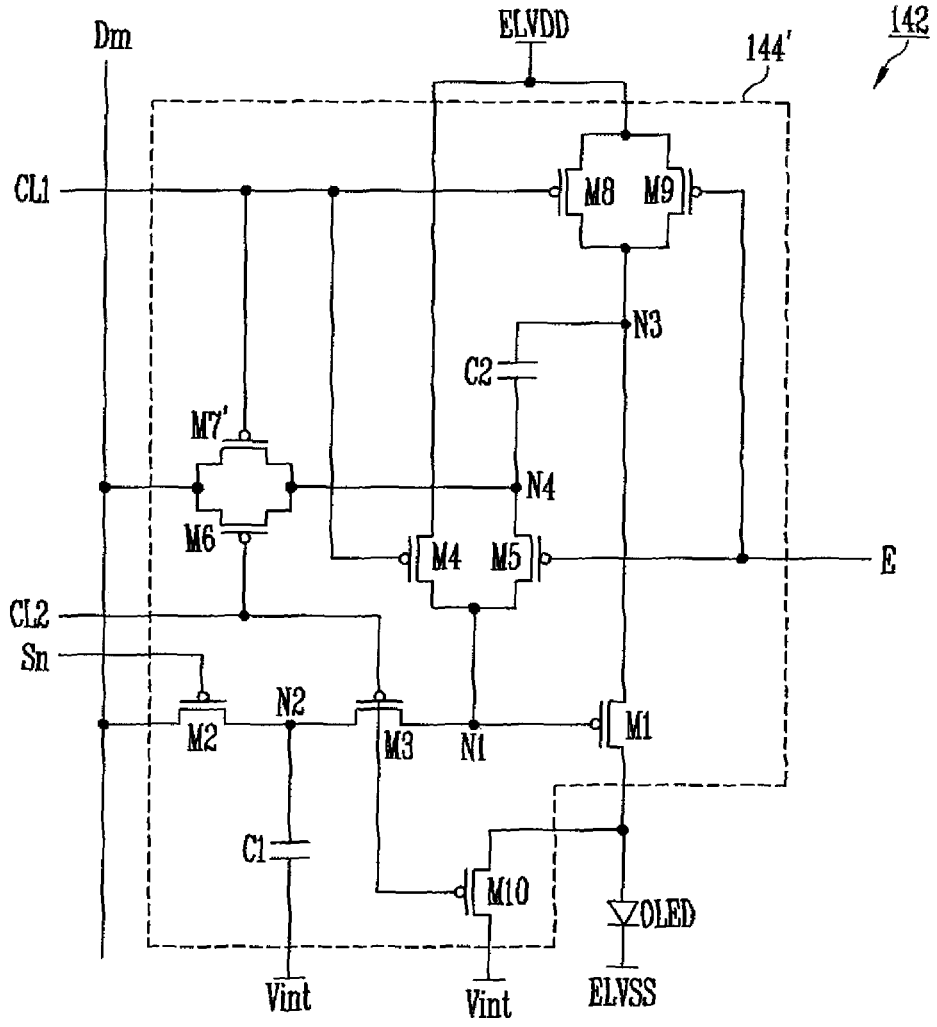
FIG. 4 is a view of the pixel illustrated in FIG. 1 according to an exemplary embodiment of the inventive concept.

FIG. 4 is a view illustrating an exemplary embodiment of the pixel illustrated in FIG. 1. In describing FIG. 4, the same elements as those of FIG. 2 are denoted by the same reference numerals and a detailed description thereof will be omitted.

Referring to FIG. 4, a pixel 142 according to the exemplary embodiment of the present inventive concept includes an OLED and a pixel circuit 144'.

The pixel circuit 144' includes a seventh transistor M7' coupled between the data line Dm and the fourth node N4. The seventh transistor M7' is turned on when the first control signal is supplied to the first control line CL1 to electrically couple the data line Dm and the fourth node N4. At this time, the voltage of the reference power supply Vref from the data line Dm is supplied to the fourth node N4. That is, according to the embodiment of the present inventive concept illustrated in FIG. 4, the other operation processes excluding that the voltage of the reference power supply Vref is supplied to the fourth node N4 during the first period T1 are the same as those of the embodiment of FIG. 2. Therefore, a detailed description of the operation processes will be omitted.

Figure 5:
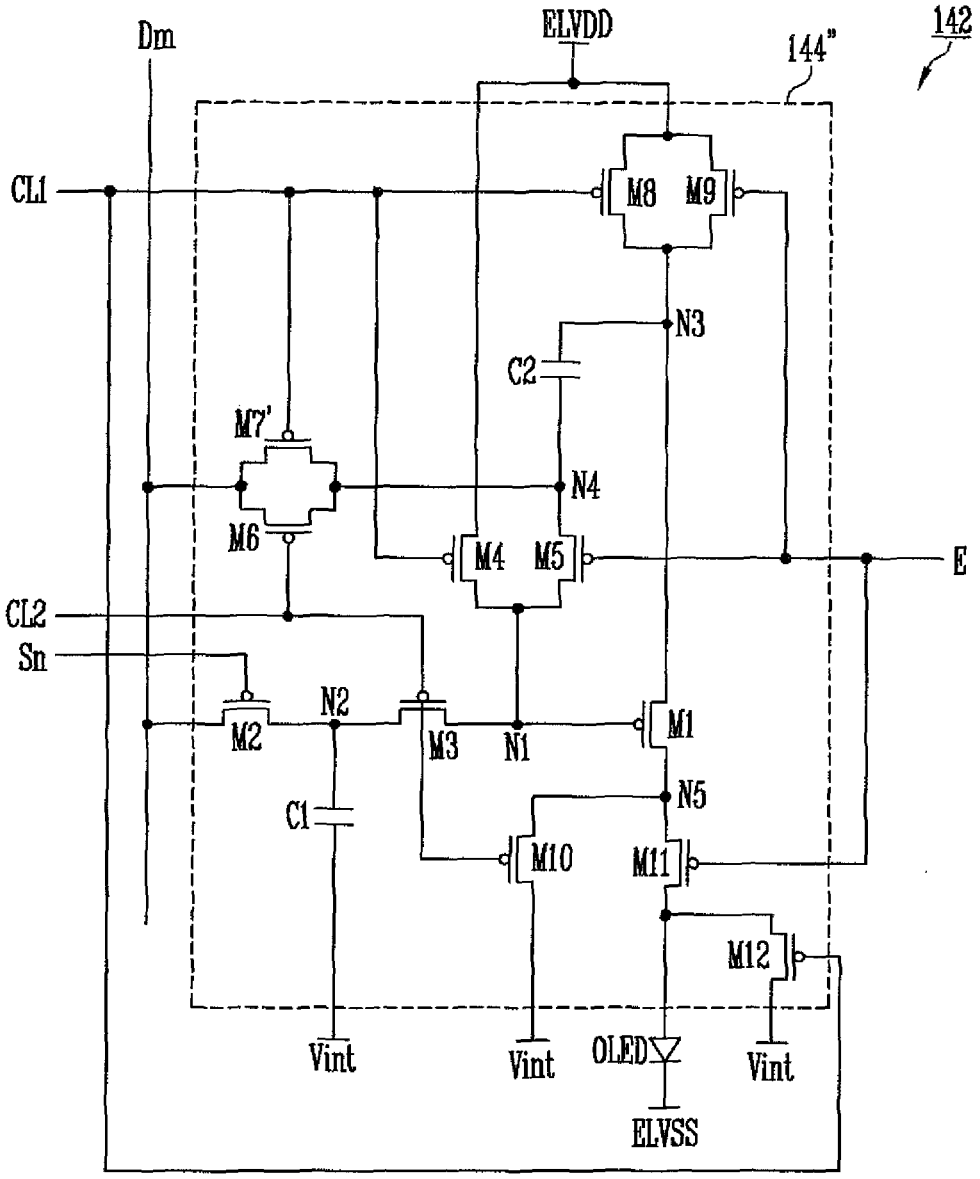
FIG. 5 is a view of the pixel illustrated in FIG. 1 according to an exemplary embodiment of the inventive concept.

FIG. 5 is a view illustrating an exemplary embodiment of the pixel illustrated in FIG. 1. In describing FIG. 5, the same elements as those of FIG. 4 are denoted by the same reference numerals and a detailed description thereof will be omitted.

Referring to FIG. 5, a pixel 142 according to an exemplary embodiment of the present inventive concept includes an OLED and a pixel circuit 144".

The pixel circuit 144" includes an $11^{th}$ transistor M11 coupled between a fifth node N 5 that is a common node of the second electrode of the first transistor M1 and the tenth transistor M10 and the anode electrode of the OLED and a $12^{th}$ transistor M12 coupled between the anode electrode of the OLED and the initializing power supply Vint.

A gate electrode of the $11^{th}$ transistor M11 is coupled to the emission control line E. The $11^{th}$ transistor M11 is turned off during the first period T1 and the second period T2 in which the emission control signal is supplied to the emission control line E and is turned on in the third period T3 in which the emission control signal is not supplied. For example, when the emission control signal is activated, the $11^{th}$ transistor is turned off and when the emission control signal is deactivated, the $11^{th}$ transistor is turned on. When the $11^{th}$ transistor M11 is turned off, the fifth node N5 and the anode electrode of the OLED are electrically insulated from each other. That is, the $11^{th}$ transistor M11 electrically insulates the OLED from the fifth node N5 in the first period T1 and the second period T2 to prevent unnecessary light from being generated.

A gate electrode of the $12^{th}$ transistor M12 is coupled to the first control line CL1. The $12^{th}$ transistor M12 is turned on during a period when the first control signal is supplied to the first control line CL to supply the voltage of the initializing power supply Vint to the anode electrode of the OLED. For example, the $12^{th}$ transistor M12 is turned on when the first control signal is activated.

Figure 6:
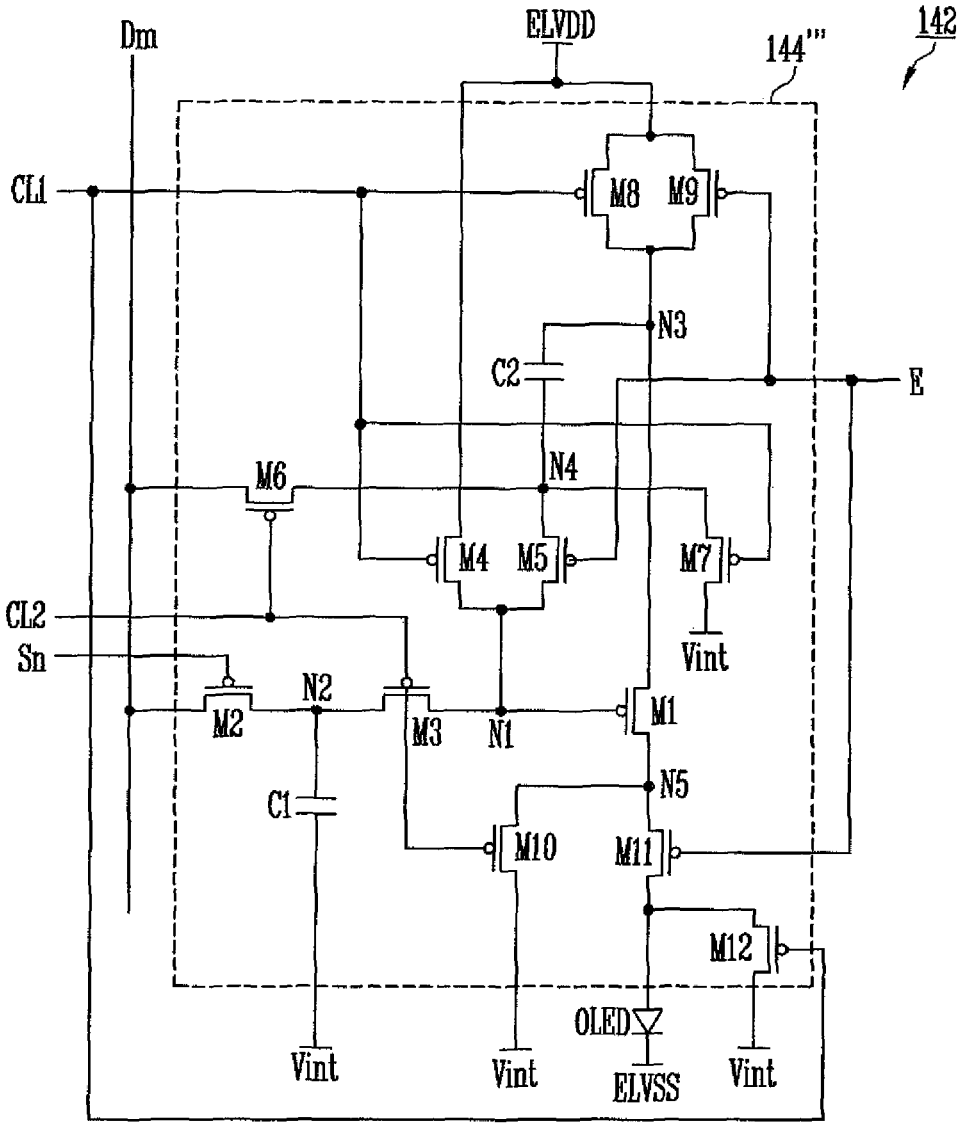
FIG. 6 is a view of the pixel illustrated in FIG. 1 according to an exemplary embodiment of the inventive concept.

FIG. 6 is a view illustrating the pixel illustrated in FIG. 1 according to an exemplary embodiment of the inventive concept. In describing FIG. 6, the same elements as those of FIG.

2 are denoted by the same reference numerals and a detailed description thereof will be omitted.

Referring to FIG. 6, a pixel 142 according to an exemplary embodiment of the present inventive concept includes an OLED and a pixel circuit 144".

The pixel circuit 144" includes an $11^{th}$ transistor M11 coupled between the fifth node N5 and the anode electrode of the OLED and a $12^{th}$ transistor M12 coupled between the anode electrode of the OLED and the initializing power supply Vint.

A gate electrode of the $11^{th}$ transistor M11 is coupled to the emission control line E. The $11^{th}$ transistor M11 is turned off in the first period T1 and the second period T2 when the emission control signal is supplied to the emission control line E and is turned on in the third period when the emission control signal is not supplied. For example, the $11^{th}$ transistor is turned off when the emission control is activated and turned on when the emission control signal is deactivated. When the $11^{th}$ transistor M11 is turned off, the fifth node N5 and the anode electrode of the OLED are electrically insulated from each other. That is, the $11^{th}$ transistor M11 electrically insulates the OLED from the fifth node N5 during the first period T1 and the second period T2 to prevent unnecessary light from being generated.

A gate electrode of the $12^{th}$ transistor M12 is coupled to the first control line CL1. The $12^{th}$ transistor M12 is turned on during a period when the first control signal is supplied to the first control line CL1 to supply the voltage of the initializing power supply Vint to the anode electrode of the OLED.

Figure 7:
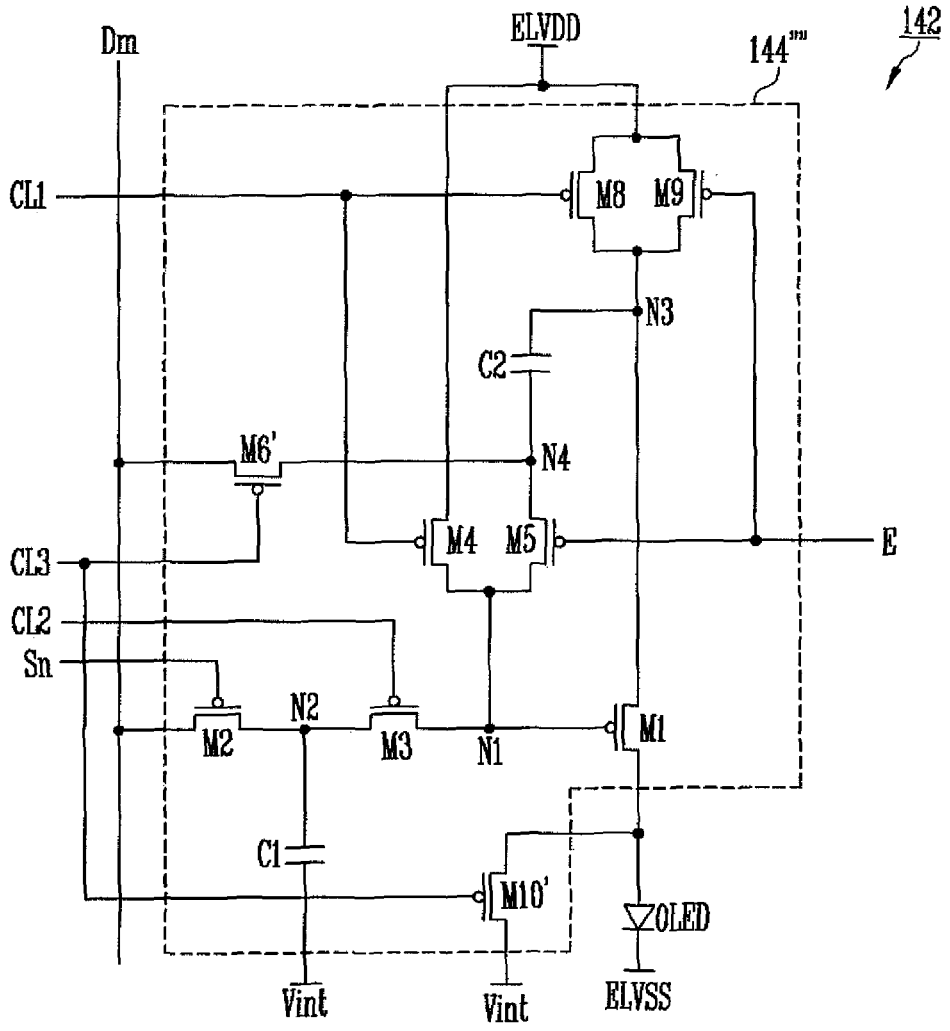
FIG. 7 is a view of the pixel illustrated in FIG. 1 according to an exemplary embodiment of the inventive concept.

FIG. 7 is a view illustrating the pixel illustrated in FIG. 1 according to an exemplary embodiment of the inventive concept. In describing FIG. 7, the same elements as those of FIG. 2 are denoted by the same reference numerals and a detailed description thereof will be omitted.

Referring to FIG. 7, a pixel 142 according to an exemplary embodiment of the present inventive concept includes an OLED and a pixel circuit 144"".

The pixel circuit 144"' includes a sixth transistor M6' coupled between the data line Dm and the fourth node N4 and a tenth transistor M10' coupled between an anode electrode of the OLED and the initializing power supply Vint. The sixth transistor m6' and the tenth transistor M10' are turned on when a third control signal is supplied to a third control line CL3. Here, the third control signal is supplied during the first period T1 and the second period T2 from the control driver 120.

The sixth transistor M6' is turned on during the first period T1 and the second period T2 to electrically couple the fourth node N4 and the data line Dm. Since the fourth node N4 and the data line Dm are coupled during the first period T1 and the second period T2, the seventh transistor M7 illustrated in FIG. 2 is omitted.

The tenth transistor M10' is turned on during the first period T1 and the second period T2 to electrically couple the anode electrode of the OLED and the initializing power supply Vint.

Figure 8:
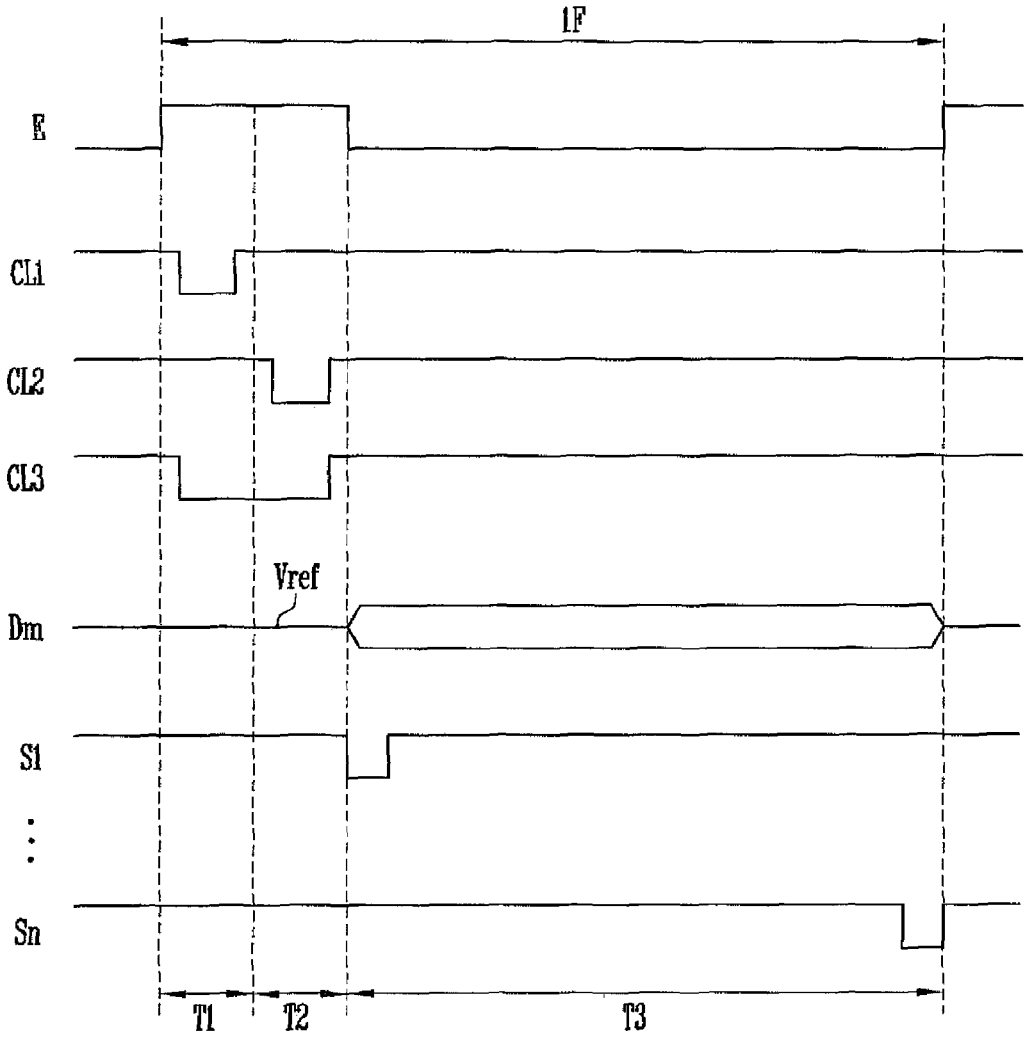
FIG. 8 is a waveform diagram illustrating a method of driving the pixel illustrated in FIG. 7 according to an exemplary embodiment of the inventive concept.

FIG. 8 is an exemplary waveform diagram illustrating a method of driving the pixel illustrated in FIG. 7 according to an exemplary embodiment of the inventive concept.

Referring to FIG. 8, the fifth transistor M5 and the ninth transistor M9 are set in a turn-off state to correspond to the emission control signal supplied to the emission control line E during the first period T1 and the second period T2. For example, the fifth transistor M5 and the ninth transistor M9 are turned off when the emission control signal is activated (e.g., set to a high level).

The sixth transistor M6' and the tenth transistor M10' are turned on to correspond to the third control signal supplied to the third control line CL3 during the first period T1 and the second period T2. For example, the sixth transistor M6' and the tenth transistor M10' are turned on when the third control signal is activated (e.g., set to a low level).

When the sixth transistor M6' is turned on, the fourth node n4 and the data line Dm are electrically coupled to each other. Then, the voltage of the reference power supply Vref from the data line Dm is supplied to the fourth node N4. When the tenth transistor M10' is turned on, the initializing power supply Vint and the anode electrode of the OLED are electrically coupled to each other. In this case, the current supplied from the first transistor M1 is supplied to the initializing power supply Vint via the tenth transistor M10'.

The fourth transistor M4 and the eighth transistor M8 are turned on to correspond to the first control signal supplied to the first control line CL1 during the first period T1. For example, the fourth transistor M4 and the eighth transistor M8 are turned when the first control signal is activated (e.g., set to a low level).

When the eighth transistor M8 is turned on, the voltage of the first power supply ELVDD is supplied to the third node N3 . When the fourth transistor m4 is turned on, the voltage of the first power supply ELVDD is supplied to the first node N1. When the voltage of the first power supply ELVDD is supplied to the first node N1 and the third node N3 , the first transistor M1 is turned off. That is, during the first period T1, the first transistor M1 is initialized to an off bias state regardless of the voltage of the previous data signal so that an image with a uniform brightness may be displayed.

During the second period T2, the third transistor M3 is turned on to correspond to the second control signal supplied to the second control line CL2. For example, the third transistor M3 is turned when the second control signal is activated (e.g., set to a high level). When the third transistor M3 is turned on, the second node N2 and the first node N1 are electrically coupled to each other so that the voltage of the data signal stored in the first capacitor C1 is supplied to the first node N1.

At this time, since the fifth transistor M5 is set in a turn-off state, the second capacitor C2 is not electrically coupled to the first capacitor C1. When the voltage of the data signal is supplied to the first node N1, the voltage of the third node N3 is reduced from the voltage of the first power supply ELVDD to the voltage corresponding to the sum of the voltage of the data signal and the absolute value of the threshold voltage of the first transistor M1. At this time, the second capacitor C2 is charged with the voltage corresponding to the difference between the voltage of the fourth node N4 and the voltage of the third node N3 , that is, the voltage corresponding to the threshold voltage of the first transistor M1 and the data signal.

During the third period T3, the supply of the emission control signal to the emission control line E is stopped. For example, the emission control signal is deactivated (e.g., set to a low level). When the supply of the emission control signal to the emission control line E is stopped, the fifth transistor M5 and the ninth transistor M9 are turned on. When the ninth transistor M9 is turned on, the voltage of the first power supply ELVDD is supplied to the third node N3 . When the fifth transistor M5 is turned on, the first node N1 and the fourth node N4 are electrically coupled to each other. At this time, the voltage of the first node N1 is set to the voltage of the reference power supply Vref. Then, the voltage difference between the first electrode of the first transistor M1 and the gate electrode of the first transistor M1 is set to the voltage obtained by subtracting the voltage of the reference power supply Vref from the voltage corresponding to the sum of the voltage of the data signal and the absolute value of the threshold voltage of the first transistor M1. Here, since the voltage of the reference power supply Vref is a fixed voltage, the amount of current that flows through the first transistor M1 is determined by the data signal and the threshold voltage of the first transistor M1.

During the third period T3, the scan signals are sequentially supplied to the scan lines S1 to Sn. When the scan signal is supplied to the scan line Sn, the second transistor M2 is turned on. When the second transistor M2 is turned on, the data signal supplied to the data line Dm in synchronization with the scan signal supplied to the scan line Sn is supplied to the second node N2 so that the first capacitor C1 stores the voltage corresponding to the data signal.

For convenience sake, the transistors depicted in the figures are illustrated as PMOS transistors. However, the present inventive concept is not limited to PMOS transistors. That is, the transistors may be NMOS transistors. However, when a PMOS transistor is replaced with an NMOS transistor, the signal applied to turn on/off the NMOS transistor is different from the signal applied to turn on/off the PMOS transistor. Thus, the waveforms illustrated in FIG. 3 and FIG. 8 may need to be changed to support the above-described pixel driving methods when different transistors types are used.

In addition, according to at least one embodiment of the present inventive concept, the OLED generates light of a specific color to correspond to the amount of current supplied from the driving transistor. However, the present inventive concept is not limited thereto. For example, the OLED may generate white light to correspond to the amount of current supplied from the driving transistor. In this case, a color image is realized using an additional color filter.

According to an exemplary embodiment of the inventive concept, an organic light emitting display device includes a plurality of pixels arranged at intersections of a plurality of data lines, scan lines, and power supply lines in a matrix. Each of the pixels may include an OLED, at least two transistors including a driving transistor, and at least one capacitor.

The organic light emitting display device may have low power consumption. However, amounts of currents that flow to the OLEDs are changed in accordance with a deviation in threshold voltages of the driving transistors included in the pixels so that non-uniformity in display may be caused. That is, in accordance with manufacturing process variables of the driving transistors included in the pixels, actual characteristics of the driving transistors may differ from their intended characteristics. For example, since it may not be possible to manufacture all of the transistors of the organic light emitting display device to have the same characteristics, deviations in the threshold voltages of the driving transistors may occur.

A method of adding a compensating circuit formed of a plurality of transistors and capacitors to each of the pixels may be used to compensate for the deviations. The compensating circuits included in the pixels charge voltages corresponding to the threshold voltages of the driving transistors in one horizontal period so that the deviation in the threshold voltages of the driving transistors is compensated for.

As an example, a method of driving the organic light emitting display device at a driving frequency of no less than 240 Hz may be used to remove a motion blur phenomenon and/or to realize a 3D image. However, when the organic light emitting display device is driven at a high speed of no less than 240 Hz, a period of charging the threshold voltages of the driving transistors is reduced so that it is difficult or not possible to compensate for the threshold voltages of the driving transistors. In addition, when the organic light emitting display device is driven at the driving frequency of no less than 240 Hz, emission time is reduced so that a large amount of (or high) current needs to be supplied to realize desired gray scales.

A structure in which the driving power supplies the first power supply ELVDD and the second power supply ELVSS changed to correspond to high speed driving may be used. However, when the driving power supplies are changed, high power consumption and large electromagnetic interference (EMI) may occur.

In a pixel according to at least one exemplary embodiment of the present inventive concept and the organic light emitting display device using the same, the pixels commonly compensate for the threshold voltages so that a period of compensating for the threshold voltages may be sufficiently secured. Therefore, display quality may be improved. In addition, according to at least one embodiment of the present inventive concept, a constant voltage is maintained without changing the driving power supplies so that the power consumption and the EMI may be minimized.

Furthermore, according to at least one embodiment of the present inventive concept, since the data signals are charged during the period when the pixels emit light, the driving frequency may be reduced (for example, 120 Hz) so that an amount of current for realizing gray scales may be minimized. In addition, according to at least one embodiment of the present inventive concept, during a period when a first capacitor that is primarily charged with a data signal supplies a voltage to a gate electrode of a driving transistor, the first capacitor (e.g., C1) is electrically insulated from a second capacitor (e.g., C2) coupled to the gate electrode of the driving transistor. That is, the second capacitor is not charged by a charge sharing method with the first capacitor so that a capacitance of the first capacitor may be minimized.

Although exemplary embodiments of the present inventive concept have been described for illustrative purposes, various modifications, additions and substitutions are possible, without departing from the scope and spirit of the inventive concept.

What is claimed is:

1. A pixel comprising:

an organic light emitting diode (OLED);

a first transistor whose gate electrode is coupled to a first node, whose first electrode is coupled to a first power supply via a third node, and whose second electrode is coupled to an anode electrode of the OLED;

a second transistor coupled between a data line and a second node and turned on when a scan signal is supplied to a scan line;

a first capacitor coupled between the second node and a first voltage source;

a third transistor whose first non-gate electrode is constantly coupled to the second node, whose second non-gate terminal is constantly coupled to the first node, and wherein the third transistor is turned on when a second control signal is supplied to a gate terminal of the third transistor;

a fourth transistor coupled between the first node and the first power supply and turned on when a first control signal is supplied;

a fifth transistor coupled between the first node and a fourth node, turned off when an emission control signal is supplied to an emission control line, and turned on when the emission control signal is not supplied to the emission control line;

a second capacitor coupled between the fourth node and the third node;

a sixth transistor coupled between the data line and the fourth node and turned on when the second control signal is supplied;

a seventh transistor coupled between the fourth node and a second voltage supply and turned on when the first control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between an anode electrode of the OLED and an initializing power supply and turned on when the second control signal is supplied.

2. The pixel of claim 1, wherein turn-on periods of the second transistor, the third transistor, and the fourth transistor do not overlap.

3. The pixel of claim 1, wherein a turn-on period of the fifth transistor does not overlap the turn-on periods of the third transistor and the fourth transistor.

4. The pixel of claim 1, wherein the fifth transistor is set in a turn-on state during a period when the second transistor is turned on.

5. The pixel of claim 1, wherein a voltage of the initializing power supply is set so that a current from the first transistor flows via the tenth transistor during a period when the second control signal is supplied.

6. The pixel of claim 1, wherein the first voltage supply and the second voltage supply are the initializing power supply.

7. The pixel of claim 1, further comprising:

an $11^{th}$ transistor coupled between a fifth node that is a common node of the tenth transistor and the second electrode of the first transistor and the anode electrode of the OLED, turned off when the emission control signal is supplied to the emission control line, and turned on when the emission control signal is not supplied to the emission control line; and a $12^{th}$ transistor coupled between the anode electrode of the OLED and the initializing power supply and turned on when the first control signal is supplied.

8. A pixel comprising:

an organic light emitting diode (OLED);

a first transistor whose gate electrode is coupled to a first node, whose first electrode is coupled to a first power supply via a third node, and whose second electrode is coupled to an anode electrode of the OLED;

a second transistor coupled between a data line and a second node and turned on when a scan signal is supplied to a scan line;

a first capacitor coupled between the second node and a first voltage source;

a third transistor whose first non-gate electrode is constantly coupled to the second node, whose second non-gate terminal is constantly coupled to the first node, and wherein the third transistor is turned on when a second control signal is supplied to a gate terminal of the third transistor;

a fourth transistor coupled between the first node and the first power supply and turned on when a first control signal is supplied;

a fifth transistor coupled between the first node and a fourth node, turned off when an emission control signal is supplied to an emission control line, and turned on when the emission control signal is not supplied to the emission control line;

a second capacitor coupled between the fourth node and the third node;

a sixth transistor coupled between the data line and the fourth node and turned on when the second control signal is supplied;

a seventh transistor coupled between the data line and the fourth node in parallel with the sixth transistor and turned on when the first control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the second control signal is supplied.

9. The pixel of claim 8, further comprising:

an $11^{th}$ transistor coupled between a fifth node that is a common node of the tenth transistor and the second electrode of the first transistor and the anode electrode of the OLED, turned off when the emission control signal is supplied to the emission control line, and turned on when the emission control signal is not supplied to the emission control line; and a $12^{th}$ transistor coupled between the anode electrode of the OLED and the initializing power supply and turned on when the first control signal is supplied.

10. A pixel comprising:

an organic light emitting diode (OLED);

a first transistor whose gate electrode is coupled to a first node, whose first electrode is coupled to a first power supply via a third node, and whose second electrode is coupled to an anode electrode of the OLED;

a second transistor coupled between a data line and a second node and turned on when a scan signal is supplied to a scan line;

a first capacitor coupled between the second node and a first voltage source;

a third transistor whose first non-gate electrode is constantly coupled to the second node, whose second non-gate terminal is constantly coupled to the first node, and wherein the third transistor is turned on when a second control signal is supplied to a gate terminal of the third transistor;

a fourth transistor coupled between the first node and the first power supply and turned on when a first control signal is supplied;

a fifth transistor coupled between the first node and a fourth node, turned off when an emission control signal is supplied to an emission control line, and turned on when the emission control signal is not supplied to the emission control line;

a second capacitor coupled between the fourth node and the third node;

a sixth transistor coupled between the data line and the fourth node and turned on when a third control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the third control signal is supplied.

11. The pixel of claim 10, wherein a turn-on period of the sixth transistor overlaps the turn-on periods of the third transistor and the fourth transistor.

12. An organic light emitting display device, comprising:

a control driver configured to supply a first control signal to a first control line during a first period of one frame and to supply a second control signal to a second control line during a second period of the one frame;

a scan driver configured to sequentially supply scan signals to scan lines during a third period of the one frame and to supply an emission control signal to an emission control line during the first period and the second period of the one frame;

a data driver configured to supply a reference power supply to data lines during the first period and the second period and to supply data signals to the data lines in synchronization with the scan signals during the third period; and a plurality of pixels, wherein one of the pixels comprises:

an organic light emitting diode (OLED);

a first transistor whose gate electrode is coupled to a first node, whose first electrode is coupled to a first power supply via a third node, and whose second electrode is coupled to an anode electrode of the OLED;

a second transistor coupled between a data line and a second node and turned on when a scan signal is supplied to one of the scan lines corresponding to the one pixel;

a first capacitor coupled between the second node and a first voltage source;

a third transistor coupled between the second node and the first node and turned on when the second control signal is supplied; and a fourth transistor coupled between the first node and the first power supply and turned on when the first control signal is supplied.

13. The organic light emitting display device of claim 12, wherein the reference power supply is set to a specific voltage within a voltage range of the data signals.

14. The organic light emitting display device of claim 12, wherein the one pixel further comprises:

a fifth transistor coupled between the first node and a fourth node, turned off when the emission control signal is supplied, and turned on when the emission control signal is not supplied; and a second capacitor coupled between the fourth node and the third node.

15. The organic light emitting display device of claim 14, wherein the one pixel comprises:

a sixth transistor coupled between the data line and the fourth node and turned on when the second control signal is supplied;

a seventh transistor coupled between the fourth node and a second voltage supply and turned on when the first control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the second control signal is supplied.

16. The organic light emitting display device of claim 15, wherein a voltage of the initializing power supply is set so that a current from the first transistor flows via the tenth transistor during the second period.

17. The organic light emitting display device of claim 15, wherein the first voltage supply and the second voltage supply are the initializing power supply.

18. The organic light emitting display device of claim 15, wherein the one pixel further comprises:

an $11^{th}$ transistor coupled between a fifth node that is a common node of the tenth transistor and the second electrode of the first transistor and the anode electrode of the OLED, turned off when the emission control signal is supplied, and turned on when the emission control signal is not supplied; and a $12^{th}$ transistor coupled between the anode electrode of the OLED and the initializing power supply and turned on when the first control signal is supplied.

19. The organic light emitting display device of claim 14, wherein the one pixel further comprises:

a sixth transistor coupled between the data line and the fourth node and turned on when the second control signal is supplied;

a seventh transistor coupled between the data line and the fourth node in parallel with the sixth transistor and turned on when the first control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the second control signal is supplied.

20. The organic light emitting display device of claim 19, wherein the one pixel further comprises:

an $11^{th}$ transistor coupled between a fifth node that is a common node of the tenth transistor and the second electrode of the first transistor and the anode electrode of the OLED, turned off when the emission control signal is supplied, and turned on when the emission control signal is not supplied; and a $12^{th}$ transistor coupled between the anode electrode of the OLED and the initializing power supply and turned on when the first control signal is supplied.

21. The organic light emitting display device of claim 14, wherein the control driver supplies a third control signal to a third control line during the first period and the second period.

22. The organic light emitting display device of claim 21, wherein the one pixel further comprises:

a sixth transistor coupled between the data line and the fourth node and turned on when a third control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the third control signal is supplied.

23. An organic light emitting display device, comprising:

a scan driver configured to supply a first control signal to a first control line during a first period of one frame, a second control signal to a second control line during a second period of the one frame, and scan signals to scan lines of the display device;

a data driver configured to supply a reference power supply to data lines of the display device during the first period and the second period; and a plurality of pixels, wherein one of the pixels comprises:

an organic light emitting diode (OLED);

a first transistor whose gate electrode is coupled to a first node, whose first electrode is coupled to a first power supply via a third node, and whose second electrode is coupled to an anode electrode of the OLED;

a second transistor coupled between one of the data lines and a second node, whose gate electrode receives one of the scan signals;

a first capacitor coupled between the second node and a first voltage source;

a third transistor coupled between the second node and the first node, whose gate electrode receives the second control signal from the second control line;

a fourth transistor coupled between the first node and the first power supply, whose gate electrode receives the first control signal from the first control line;

a fifth transistor coupled between the first node and a fourth node, turned off when an emission control signal is supplied to an emission control line, and turned on when the emission control signal is not supplied to the emission control line;

a second capacitor coupled between the fourth node and the third node;

a sixth transistor coupled between the data line and the fourth node and turned on when a third control signal is supplied;

an eighth transistor coupled between the first power supply and the third node and turned on when the first control signal is supplied;

a ninth transistor coupled between the first power supply and the third node, turned off when the emission control signal is supplied, and turned on when the emission control signal is not supplied; and a tenth transistor coupled between the anode electrode of the OLED and an initializing power supply and turned on when the third control signal is supplied, wherein the first and second control signals are both deactivated in a period that overlaps the first and second time periods.

24. The organic light emitting display device of claim 23, wherein the scan driver sequentially supplies the scan signals to the scan lines during a third period of the one frame, and the data driver is configured to supply data signals to the data lines in synchronization with the scan signals during the third period.

* * * * *